United States Patent [19]

Break

[11] 4,182,016

[45] Jan. 8, 1980

[54] GUTTER SPIKE REMOVER

[76] Inventor: Douglas G. Break, 30262 Astor Rd., Farmington, Mich. 48024

[21] Appl. No.: 909,299

[22] Filed: May 24, 1978

[51] Int. Cl.[2] ..... B25B 27/00; B25C 11/00

[52] U.S. Cl. ..... 29/275; 254/18; 29/254

[58] Field of Search ..... 29/275, 254, 276, 278; 81/52.3; 254/18, 25

[56] References Cited

U.S. PATENT DOCUMENTS

| | | | |
|---|---|---|---|
| 1,903,548 | 4/1933 | Kreis | 145/21 UX |
| 2,670,535 | 3/1954 | Ogden | 29/254 |
| 3,166,757 | 1/1965 | Downs, Jr. | 145/46 |

FOREIGN PATENT DOCUMENTS

| | | | |
|---|---|---|---|
| 199852 | 9/1958 | Austria | 29/254 |

*Primary Examiner*—Robert L. Spruill
*Assistant Examiner*—Roscoe V. Parker
*Attorney, Agent, or Firm*—Willis Bugbee

[57] ABSTRACT

An elongated approximately C-shaped frame with a handle portion above an elongated hand hole has downwardly-projecting arms depending from its forward and rearward ends. The forward arm is bifurcated by being keyhole-slotted vertically into a pair of laterally-spaced L-shaped fingers which straddle the spike and the tubular spacer surrounding it within the gutter. The rearward depending arm is provided with an impact abutment for receiving hammer blows during use. A strengthening rib extending along the body between the depending portions imparts rigidity to the frame. In the first stage of its use, the forward depending arm is moved over the top of the gutter and dropped around the tubular spacer, then pulled toward the user until the flat ends of the fingers engage the inner surface of the outer gutter wall directly beneath the spike. A hammer blow on the abutment on the rearward arm pulls spike, spacer and gutter bodily a short distance away from the building wall to which they are attached. Thereupon the device is lifted out of the gutter, which is then pushed back toward the building wall to space the head of the spike and the adjacent portion of its shank away from the forward wall of the gutter. The forward arm of the device is then dropped around this projecting portion of the spike and pulled backward against its head, whereupon hammer blows against the abutment cause the spike to be pulled completely out of the gutter and tubular spacer, which drops into the gutter.

3 Claims, 6 Drawing Figures

FIG.1
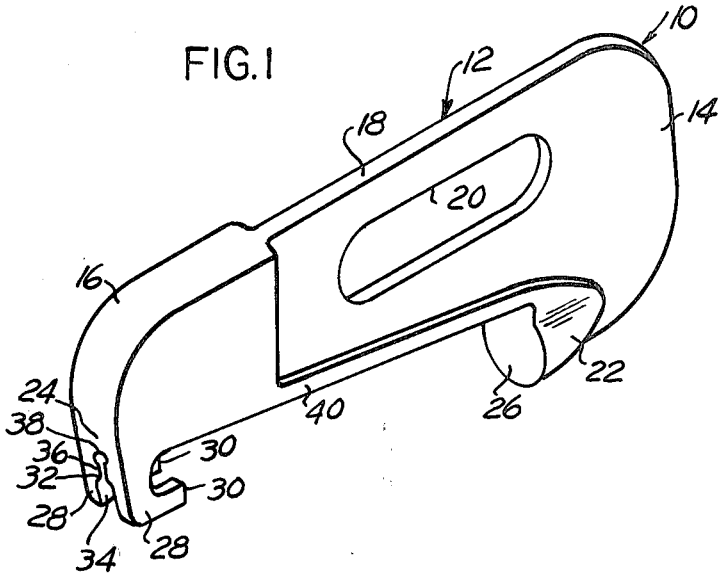
FIG.4
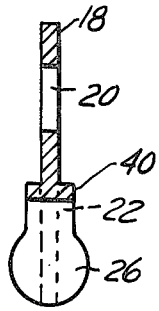
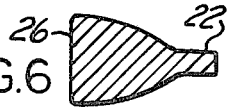
FIG.6
FIG.2
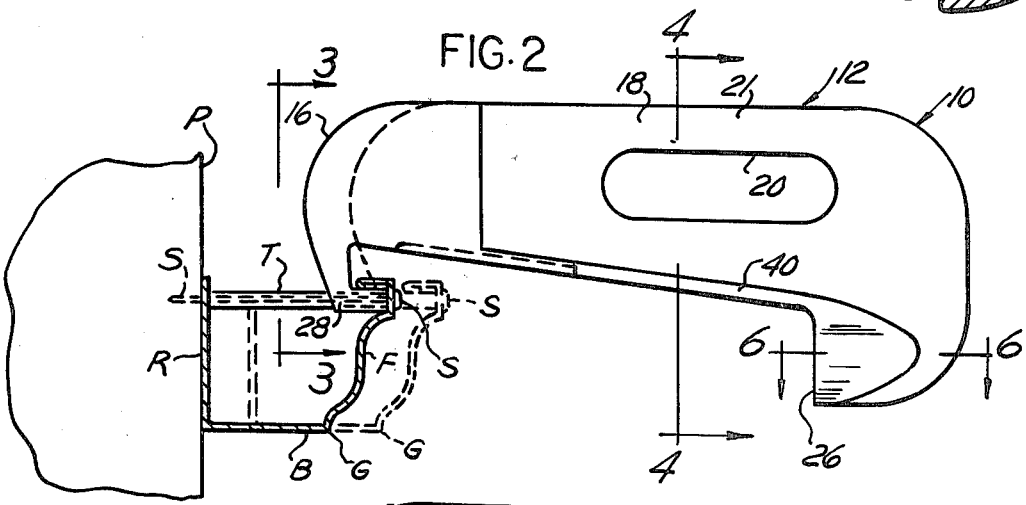
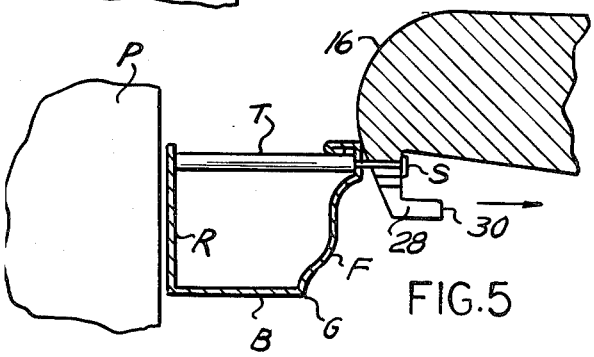
FIG.5
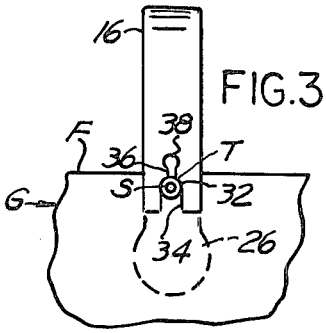
FIG.3

GUTTER SPIKE REMOVER

SUMMARY OF THE INVENTION

The invention particularly resides in the elongated frame with its bifurcated L-shaped keyhole slotted forward depending arm and its abutment-equipped rearward depending arm spaced longitudinally away from the forward arm.

In the drawing,

FIG. 1 is a perspective view, looking downward from above, of a gutter spike remover according to a preferred form of the invention;

FIG. 2 is a side elevation of the gutter spike remover with the gutter in cross-section showing in solid lines the beginning of its first stage of application to the gutter, tubular spacer and spike and in dotted lines the positions of these parts at the end of its first stage of use;

FIG. 3 is a left-hand end elevation of the gutter spike remover with the spike and tubular spacer in cross-section, taken along the line 3—3 in FIG. 2;

FIG. 4 is a vertical section through the frame of the gutter spike remover taken along the line 4—4 in FIG. 2; and FIG. 5 is a fragmentary central vertical section through the forward end portion of the gutter spike remover shown in FIGS. 1 and 2, but with the forward depending arm disposed at the beginning of its second stage of use with the gutter pushed back against the building wall, and with the gutter spike extracted from the building wall but not yet removed from its tubular spacer and with an arrow indicating the direction of pull; and FIG. 6 is a horizontal section through the hammer blowimpact abutment and rearward depending arm, taken along the line 6—6 in FIG. 2.

Referring to the drawing in detail, FIGS. 1 and 2 show a gutter spike remover, generally designated 10, which, as its name indicates, is used by gutter and downspout installing workmen to remove gutter-holding spikes S and their tubular spacers T from the building wall W to which the trough-shaped gutters are normally attached. The gutter spike remover 10 consists of an elongated frame 12 with a rearward portion 14, a forward portion 16 and an intermediate portion 18 with an elongated hand hole 20 and handle portion 21 for receiving the fingers and hand respectively of the user during use. Depending from the rearward and forward portions 14 and 16 are downwardly-projecting rearward and forward arms 22 and 24 respectively.

Mounted on and preferably integral with the rearward arm 22 is a hammer blow impact abutment 26 which, as its name signifies, is for the reception of hammer blows imparted to it during its use. The forward arm 24 includes a pair of L-shaped fingers 28 provided with rearwardly extending flat-ended horizontal portions 30. The fingers 28 are separated and spaced laterally apart from one another by a keyhole slot 32 having a wider lower portion 34 and a narrower upper portion 36 terminating in a round top portion 38. The intermediate portion 18 of the frame 12 is of T-shaped cross-section (FIG. 4) with a rib 40 extending along the lower edge thereof between the rearward and forward portions 14 and 16.

In the use of the gutter spike remover 10 (FIG. 2), the user grasps the intermediate portion 18 of the frame 12 in his hand with his fingers extending through the slongated hand hole 20 and around the handle portion 21. He then raises the forward end portion 16 so that it passes over the forward wall F of the gutter G having bottom and rearward walls B and R respectively. He now drops the forward depending arm 24 so that its fingers 28 lie on opposite sides of the tubular spacer T which occupies the wider lower portion 34 of the slot 32 (FIG. 3). He then pulls backward upon the frame 12 so that the horizontal portions 30 of the fingers 28 move beneath the flange on the gutter forward wall F until the flat ends of the horizontal portions 30 of the L-shaped fingers 28 press against the inner side of the forward wall F of the gutter G (FIG. 2). He then strikes a blow or a series of blows with his hammer head against the abutment 26, thereby moving the spike remover 10 backward and consequently moving the spike S, its tubular spacer T and gutter G a short distance backward away from their solid-line positions to their dotted-line positions in FIG. 2. This action removes the pointed end of the spike S from the building wall W.

The user now raises the forward portion 16 of the gutter spike remover 10 out of the gutter G, thereby removing the forward arm 24 and its laterally-spaced fingers 28 and their slot 32 from their initial position spanning the tubular spacer T. The user then drops the slot 32 between the spaced L-shaped fingers 28 downward around the now-exposed shank portion of the spike S between the head of the latter and the forward wall F of the gutter G. The round upper portion 38 of the keyhole slot 32 now comes to rest upon the now exposed shank portion of the spike S immediately behind its head, after its wider and narrow portions 34 and 32 thereof have passed by it. With the parts in the positions shown in FIG. 5, the user then applies additional strokes of the hammer head upon the inpact abutment 26, thereby extracting the spike S fully from both its tubular spacer T and the forward wall F of the gutter G. The tubular spacer T then drops to the bottom B of the gutter G as soon as the pointed tip of the spike S passes through the forward wall F of the gutter G, whence the spacer T may then be removed by the hand of the user.

I claim:

1. A gutter spike remover for withdrawing from a building wall the supporting spike and tubular spacer therearound of a gutter, said remover comprising a horizontal frame member having an elongated intermediate portion with a depending forward arm and a depending rearward arm disposed in horizontally-spaced relationship along said intermediate portion in downwardly-offset relationship to said intermediate portion, and a forwardly-facing hammer blow impact abutment disposed on said rearward arm and extending below the lower end of said forward arm, said forward arm having a slot therethrough with an open lower end, said slot extending upward from the lower end of said forward arm and dividing said forward arm into a pair of laterally-spaced spike-extracting fingers.

2. A gutter spike remover, according to claim 1, wherein said slot has stepped lower and upper portions with the opposite sides thereof substantially parallel to one another, wherein the lower portion of said slot has a width greater than the diameter of the tubular spacer, and wherein the upper portion of said slot has a width less than the diameter of the tubular spacer but greater than the diameter of the spike.

3. A gutter spike remover, according to claim 1, wherein said fingers are approximately L-shaped with horizontal portions disposed at the bottom of said forward arm and extending rearward toward said abutment.

* * * * *